US007777735B2

(12) United States Patent
Choi et al.

(10) Patent No.: US 7,777,735 B2
(45) Date of Patent: Aug. 17, 2010

(54) DATA DRIVING INTEGRATED CIRCUIT (IC), LIGHT EMITTING DISPLAY USING THE IC, AND METHOD OF DRIVING THE LIGHT EMITTING DISPLAY DEVICE

(75) Inventors: Sang Moo Choi, Gyeonggi-do (KR); Oh-Kyong Kwon, Seoul (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 1271 days.

(21) Appl. No.: 11/315,184

(22) Filed: Dec. 23, 2005

(65) Prior Publication Data

US 2006/0139276 A1 Jun. 29, 2006

(30) Foreign Application Priority Data

Dec. 24, 2004 (KR) ..... 10-2004-0112530

(51) Int. Cl.
*G09G 3/32* (2006.01)

(52) U.S. Cl. ..... 345/204; 345/82

(58) Field of Classification Search ..... 345/55, 345/76, 89, 92, 690, 77, 87, 36, 39, 82, 84, 345/100, 204, 207; 315/169.1, 169.2, 169.3; 313/498, 500

See application file for complete search history.

(56) References Cited

U.S. PATENT DOCUMENTS 7,499,006 B2 * 3/2009 Shirasaki et al. ..... 345/76
7,515,121 B2 * 4/2009 Sato et al. ..... 345/76
7,561,147 B2 * 7/2009 Tsuge ..... 345/204
2003/0011314 A1 1/2003 Numao
2003/0063081 A1 4/2003 Kimura et al.

FOREIGN PATENT DOCUMENTS

CN 1369916 A 9/2002
CN 1385826 12/2002

(Continued)

OTHER PUBLICATIONS

Chinese Gazette issued by the SIPO on Dec. 17, 2008 in the corresponding Chinese Application No. 200510121599.5.

(Continued)

*Primary Examiner*—Abbas I Abdulselam
(74) *Attorney, Agent, or Firm*—Robert E. Bushnell, Esq.

(57) ABSTRACT

A data driving integrated circuit to display an image with a desired brightness includes: a shift register adapted to generate sampling signals in sequence; a latch adapted to store external data in response to the sampling signal; a register adapted to temporarily store the data stored in the latch; a voltage digital-analog converter adapted to generate a gradation voltage corresponding to the data stored in the register; a current digital-analog converter adapted to generate a gradation current corresponding to the data stored in the register; a buffer adapted to supply the gradation voltage as a data signal to a pixel; and a data controller adapted to receive a pixel current flowing in the pixel in correspondence to the gradation voltage and fed back from the pixel and to adjust a bit value of the data stored in the register.

18 Claims, 6 Drawing Sheets

FOREIGN PATENT DOCUMENTS

| | | |
|---|---|---|
| EP | 1 225 557 | 7/2002 |
| JP | 2004-192000 | 7/2004 |
| JP | 2004-264333 | 9/2004 |
| KR | 10-2002-0057538 | 7/2002 |
| KR | 10-2004-0037829 | 5/2004 |

OTHER PUBLICATIONS

*Office Action* from the European Patent Office issued in Applicant's corresponding European Patent Application No. 05 112 589.6 dated Aug. 7, 2008.

* cited by examiner

DATA DRIVING INTEGRATED CIRCUIT (IC), LIGHT EMITTING DISPLAY USING THE IC, AND METHOD OF DRIVING THE LIGHT EMITTING DISPLAY DEVICE

CLAIM OF PRIORITY

This application makes reference to, incorporates the same herein, and claims all benefits accruing under 35 U.S.C. §119 from an application for DATA INTEGRATED CIRCUIT AND DRIVING METHOD OF LIGHT EMITTING DISPLAY USING THE SAME earlier filed in the Korean Intellectual Property Office on the 24 Dec. 2004 and there duly assigned Serial No. 10-2004-0112530.

BACKGROUND OF THE INVENTION

1. Field of the Invention

The present invention relates to a data driving Integrated Circuit (IC), a light emitting display using the IC, and a method of driving the light emitting display, and more particularly, to a data driving IC to display an image with a desired brightness, a light emitting display using the IC, and a method of driving the light emitting display.

2. Related Art

Various flat panel displays have recently been developed as alternatives to a relatively heavy and bulky cathode ray tube (CRT) display. The flat panel display includes a liquid crystal display (LCD), a field emission display (FED), a plasma display panel (PDP), a light emitting display (OLED), etc.

Among the flat panel displays, the light emitting display can emit light for itself by electron-hole recombination. Such a light emitting display has advantages in that response time is relatively fast and power consumption is relatively low. Generally, the light emitting display employs a transistor provided in each pixel for supplying current corresponding to a data signal to a light emitting device, thereby allowing the light emitting device to emit light.

A light emitting display includes: a pixel portion having a plurality of pixels formed in a region defined by the intersections of scan lines and data lines; a scan driver to drive the scan lines; a data driver to drive the data lines; and a timing controller to control the scan driver and the data driver.

The timing controller generates a Data Control Signal (DCS) and a Scan Control Signal (SCS) corresponding to an external synchronization signal. The DCS and the SCS are supplied from the timing controller to the data driver and the scan driver, respectively. Furthermore, the timing controller supplies external data to the data driver.

The scan driver receives the scan control signal SCS from the timing controller. The scan driver generates scan signals on the basis of the scan control signal SCS and supplies the scan signals to the scan lines.

The data driver receives the DCS from the timing controller. The data driver generates data signals on the basis of the DCS and supplies the data signals to the data lines while synchronizing with the scan signals.

The display portion receives a first voltage ELVDD and a second voltage ELVSS from an external power source, and supplies them to the respective pixels. When the first voltage ELVDD and the second voltage ELVSS are supplied to the pixels, each pixel controls a current corresponding to the data signal to flow from a first voltage ELVDD to a second voltage ELVSS via the light emitting device, thereby emitting light corresponding to the data signal.

That is, in such a light emitting display, each pixel emits light with predetermined brightness corresponding to the data signal, but cannot emit light with desired brightness because transistors provided in the respective pixels are different in threshold voltage from each other. Furthermore, in such a light emitting display, there is no method of measuring and controlling a real current flowing in each pixel in correspondence with the data signal.

SUMMARY OF THE INVENTION

Accordingly, it is an aspect of the present invention to provide a data driving integrated circuit to display an image with desired brightness, a light emitting display using the data driving integrated circuit, and a method of driving the light emitting display.

The foregoing and/or other aspects of the present invention can be achieved by providing a data driving integrated circuit, comprising: a shift register adapted to generate sampling signals in sequence; a latch adapted to store external data in response to the sampling signal; a register adapted to temporarily store the data stored in the latch; a voltage digital-analog converter adapted to generate a gradation voltage corresponding to the data stored in the register; a current digital-analog converter adapted to generate a gradation current corresponding to the data stored in the register; a buffer adapted to supply the gradation voltage as a data signal to a pixel; and a data controller adapted to receive a pixel current flowing in the pixel in correspondence to the gradation voltage and fed back from the pixel and to adjust a bit value of the data stored in the register.

The data controller is preferably adapted to compare the pixel current with the gradation current, and to increase or decrease the bit value of the data stored in the register on the basis of compared results.

The data controller is preferably adapted to increase or decrease the bit value of the data by a previously set constant value.

The latch preferably comprises: a sampling latch adapted to store the data in sequence in response to the sampling signal; and a holding latch adapted to store the data stored in the sampling latch and at the same time to supply the stored data to the register.

The data controller preferably comprises j data controllers adapted to adjust the bit values of j data (where, j is a natural number).

Each data controller preferably comprises: a comparator adapted to compare the pixel current with the gradation current; and a data adjuster adapted to adjust the bit value of the data stored in the register on the basis of control by the comparator.

The data adjuster is preferably adapted to adjust the bit value of the data to make the pixel current equal to the gradation current.

The data driving integrated circuit preferably further comprises a selector arranged between the register and the current digital-analog converter.

The selector preferably comprises j switching devices, each switching device being adapted to be turned on for a first period of one horizontal period to supply the data from the register to the current digital-analog converter, and to be turned off for a second period of one horizontal period except for the first period to prevent the data having the adjusted bit value from the register being supplied to the current digital-analog converter.

The foregoing and/or other aspects of the present invention can also be achieved by providing a light emitting display, comprising: a plurality of scan lines; a plurality of data lines and feedback lines arranged to intersect the scan lines; a pixel portion including a plurality of pixels connected to the scan lines, the data lines and the feedback lines; a scan driver adapted to supply scan signals to the scan lines in sequence; and a data driver connected to the data line and the feedback lines and adapted to convert external data into a gradation voltage, and to supply the gradation voltage to the data line; wherein the data driver is adapted to receive a pixel current flowing in each pixel corresponding to the gradation voltage, and to adjust a bit value of the data in accordance with the received pixel current.

The data driver preferably comprises at least one data driving integrated circuit, each data driving integrated circuit comprising: a shift register adapted to generate sampling signals in sequence; a latch adapted to store external data in response to the sampling signal; a register adapted to temporarily store the data stored in the latch; a voltage digital-analog converter adapted to generate a gradation voltage corresponding to the data stored in the register; a current digital-analog converter adapted to generate a gradation current corresponding to the data stored in the register; a buffer adapted to supply the gradation voltage as a data signal to a pixel; and a data controller adapted to receive a pixel current flowing in the pixel in correspondence to the gradation voltage and fed back from the pixel and to adjust a bit value of the data stored in the register.

The data controller is preferably adapted to compare the pixel current with the gradation current, and to increase or decrease the bit value of the data stored in the register by a previously set constant value on the basis of compared results.

The data controller preferably comprises j data controllers adapted to adjust the bit values of j data (where, j is a natural number).

Each data controller preferably comprises: a comparator adapted to compare the pixel current with the gradation current; and a data adjuster adapted to adjust the bit value of the data stored in the register on the basis of control by the comparator.

The data adjuster is preferably adapted to adjust the bit value of the data to make the pixel current equal to the gradation current.

The foregoing and/or other aspects of the present invention can also be achieved by providing a method of driving a light emitting display, the method comprising: generating a gradation voltage and a gradation current corresponding to data; supplying the gradation voltage to pixels; comparing a pixel current flowing in one pixel in correspondence to the gradation voltage with the gradation current; and adjusting a bit value of the data on the basis of compared result.

Adjusting a bit value of the data on the basis of compared result preferably comprises increasing or decreasing the bit value of the data to equalize the pixel current with the gradation current.

Adjusting a bit value of the data on the basis of compared result preferably comprises increasing or decreasing the bit value of the data by a previously set constant value.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings, in which like reference symbols indicate the same or similar components, wherein.

DETAILED DESCRIPTION OF THE INVENTION

Figure 1:
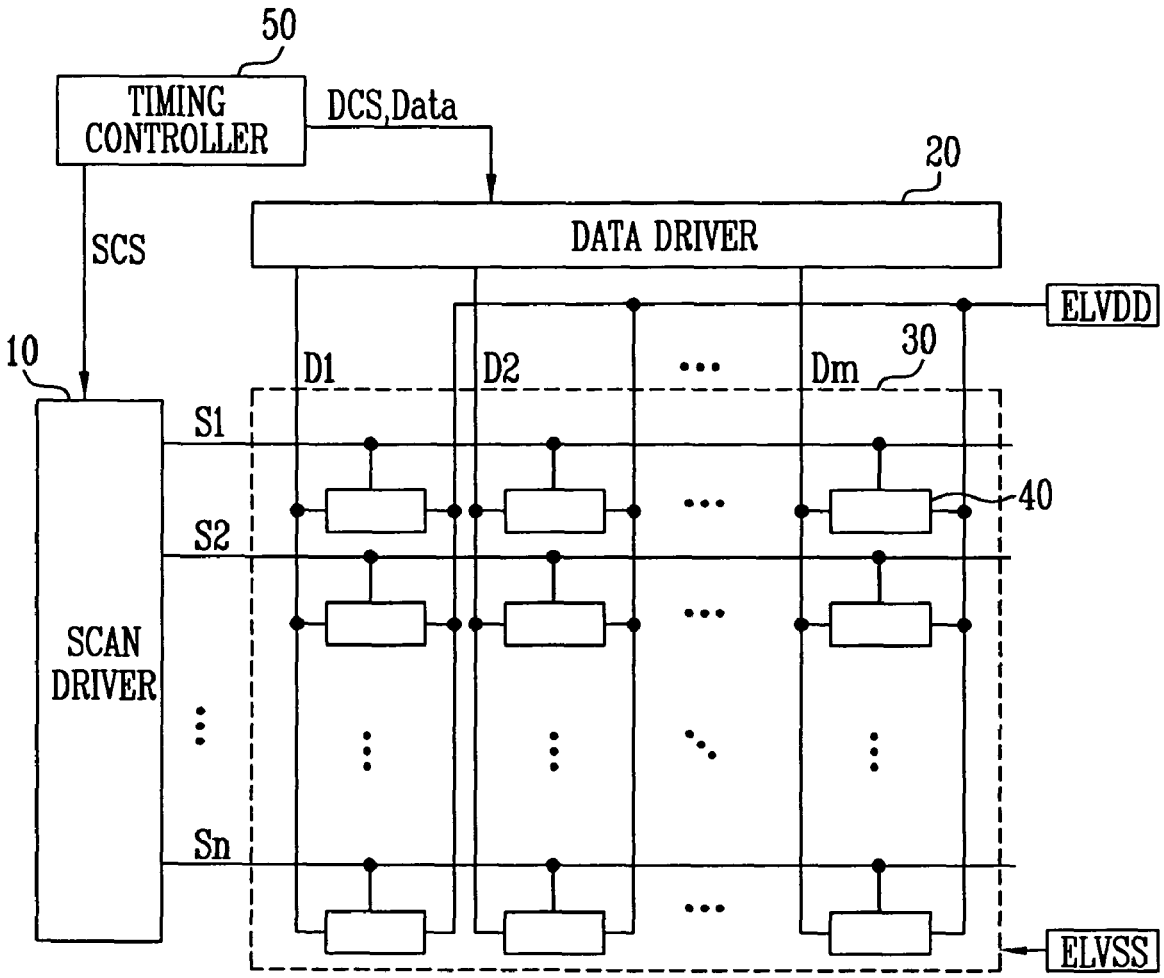
FIG. 1 is a view of a light emitting display.

Referring to FIG. 1, a light emitting display includes: a pixel portion 30 having a plurality of pixels 40 formed in a region defined by the intersections of scan lines S1 through Sn and data lines D1 through Dm; a scan driver 10 to drive the scan lines S1 through Sn; a data driver 20 to drive the data lines D1 through Dm; and a timing controller 50 to control the scan driver 10 and the data driver 20.

The timing controller 50 generates a Data Control Signal (DCS) and a Scan Control Signal (SCS) corresponding to an external synchronization signal. The DCS and the SCS are supplied from the timing controller 50 to the data driver 20 and the scan driver 10, respectively. Furthermore, the timing controller 50 supplies external data to the data driver 20.

The scan driver 10 receives the scan control signal SCS from the timing controller 50. The scan driver 10 generates scan signals on the basis of the scan control signal SCS and supplies the scan signals to the scan lines S1 through Sn.

The data driver 20 receives the DCS from the timing controller 50. The data driver 20 generates data signals on the basis of the DCS and supplies the data signals to the data lines D1 through Dm while synchronizing with the scan signals.

The display portion 30 receives a first voltage ELVDD and a second voltage ELVSS from an external power source, and supplies them to the respective pixels 40. When the first voltage ELVDD and the second voltage ELVSS are supplied to the pixels 40, each pixel 40 controls a current corresponding to the data signal to flow from a first voltage ELVDD to a second voltage ELVSS via the light emitting device, thereby emitting light corresponding to the data signal.

That is, in such a light emitting display, each pixel 40 emits light with predetermined brightness corresponding to the data signal, but cannot emit light with desired brightness because transistors provided in the respective pixels 40 are different in threshold voltage from each other. Furthermore, in such a light emitting display, there is no method of measuring and controlling a real current flowing in each pixel 40 in correspondence with the data signal.

Hereinafter, exemplary embodiments according to the present invention are described with reference to the accompanying drawings, wherein the exemplary embodiments of the present invention have been provided to be readily understood by those skilled in the art.

Figure 2:
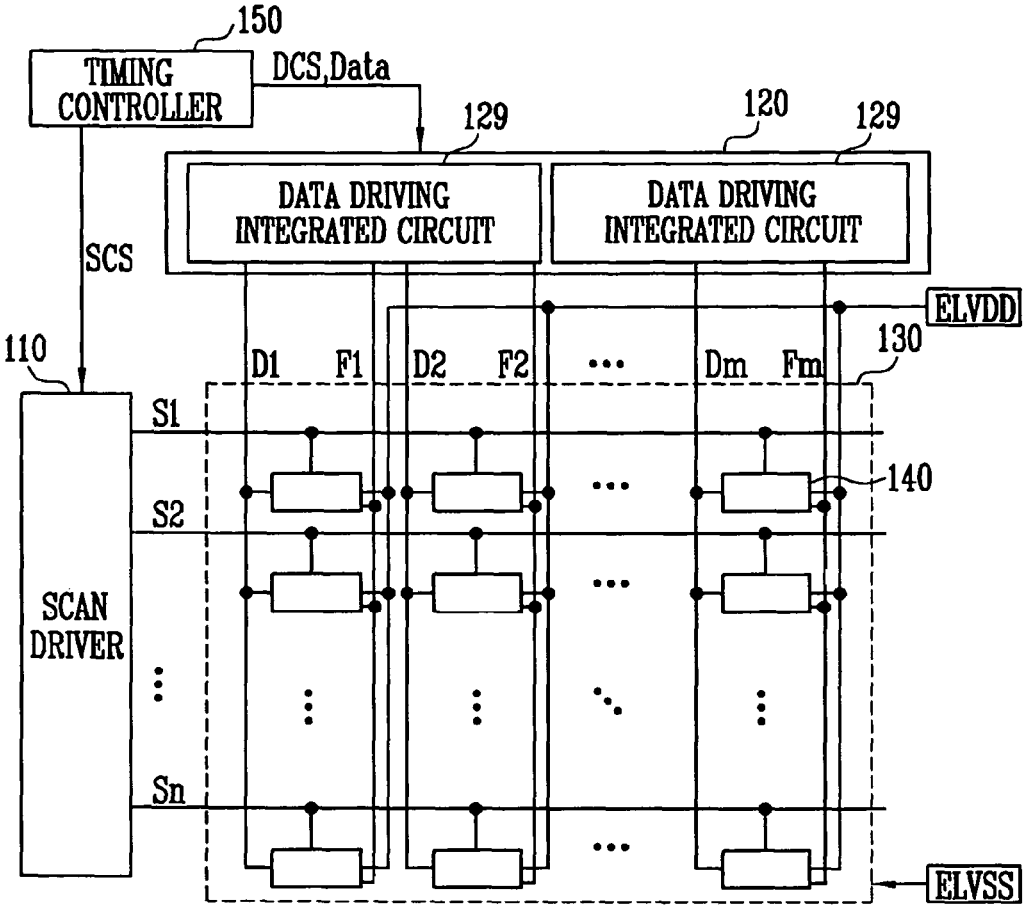
FIG. 2 is a view of a light emitting display according to an embodiment of the present invention.

FIG. 2 is a view of a light emitting display according to an embodiment of the present invention.

Referring to FIG. 2, a light emitting display according to an embodiment of the present invention includes: a pixel portion 130 having pixels 140 formed on a region intersected by scan lines S1 through Sn, data lines D1 through Dm and feedback lines F1 through Fm; a scan driver 110 to drive scan lines S1 through Sn; a data driver 120 to drive data lines D1 through Dm; and a timing controller to control the data driver 120.

The pixel portion 130 includes the plurality of the pixels 140 connected to the scan lines S1 through Sn, the data lines D1 through Dm and the feedback lines F1 through Fm. The scan lines S1 through Sn are formed horizontally and supply a scan signal to the pixels 140. The data lines D1 through Dm are formed vertically and supply a data signal to the pixels 140. The feedback lines F1 through Fm receive the pixel current from pixels 140 and supply to the data driver 120 in correspondence to the data signal. The feedback lines F1 through Fm are formed at the same direction (vertical direction) as the data lines D1 through Dm. The feedback lines F1 through Fm receive a current from the pixels 140 to which a data signal is currently being supplied. That is, the pixel current is generated by the pixels 140 currently receiving the scan signal, and is returned to the data driver 120 via the feedback lines F1 through Fm.

The first external voltage ELVDD and the second external voltage ELVSS are supplied to the pixels 140. When the first external voltage ELVDD and the second external voltage ELVSS are supplied to the pixels 140, each pixel 140 controls the pixel current corresponding to the data signal in the data lines D flowing from the first voltage ELVDD to the second voltage ELVSS via the light emitting device. Furthermore, a plurality of the pixels 140 supply the pixel current during a predetermined period of one horizontal period.

The timing controller 150 generates the data driving control signal DCS and scan driving control signal SCS in correspondence with the external synchronization signals. The data driving control signal DCS and the scan driving control signal SCS, which are generated in the timing controller 150, are respectively supplied to the data driver 120 and the scan driver 110. Furthermore, the timing controller 150 supplies the external data to the data driver 120.

The scan driver 110 receives the scan driving control signal SCS from the timing controller 150 and generates the scan signals, thereby supplying the scan signals to the scan lines S1 through Sn in sequence.

The data driver 120 receives the data driving control signal DCS from the timing controller 150 and generates the data signals, thereby supplying the data signals to the data lines D1 through Dm while synchronizing with the scanning signal. The data driver 120 supplies a predetermined gradation voltage as a data signal to the data lines D.

Furthermore, the data driver 120 receives the pixel current from the pixels 140 via feedback lines F1 through Fm. The data driver 120 receives the pixel current and checks whether the intensity of pixel current corresponds to the data. For example, when the pixel current flowing in the pixel 140 should have an intensity of 10 microamperes corresponding to a bit value (or gradation value) of the data, the data driver 120 checks whether the pixel current supplied from the pixel 140 is 10 microamperes. When the desired current is not supplied to each pixel 140, the data driver 120 adjusts the bit value (or gradation value) of the data in order to cause the desired current to flow for each pixel 140. The data driver 120 comprises at least one data driving integrated circuit 129 having j channels (where, j is a natural number).

Figure 3:
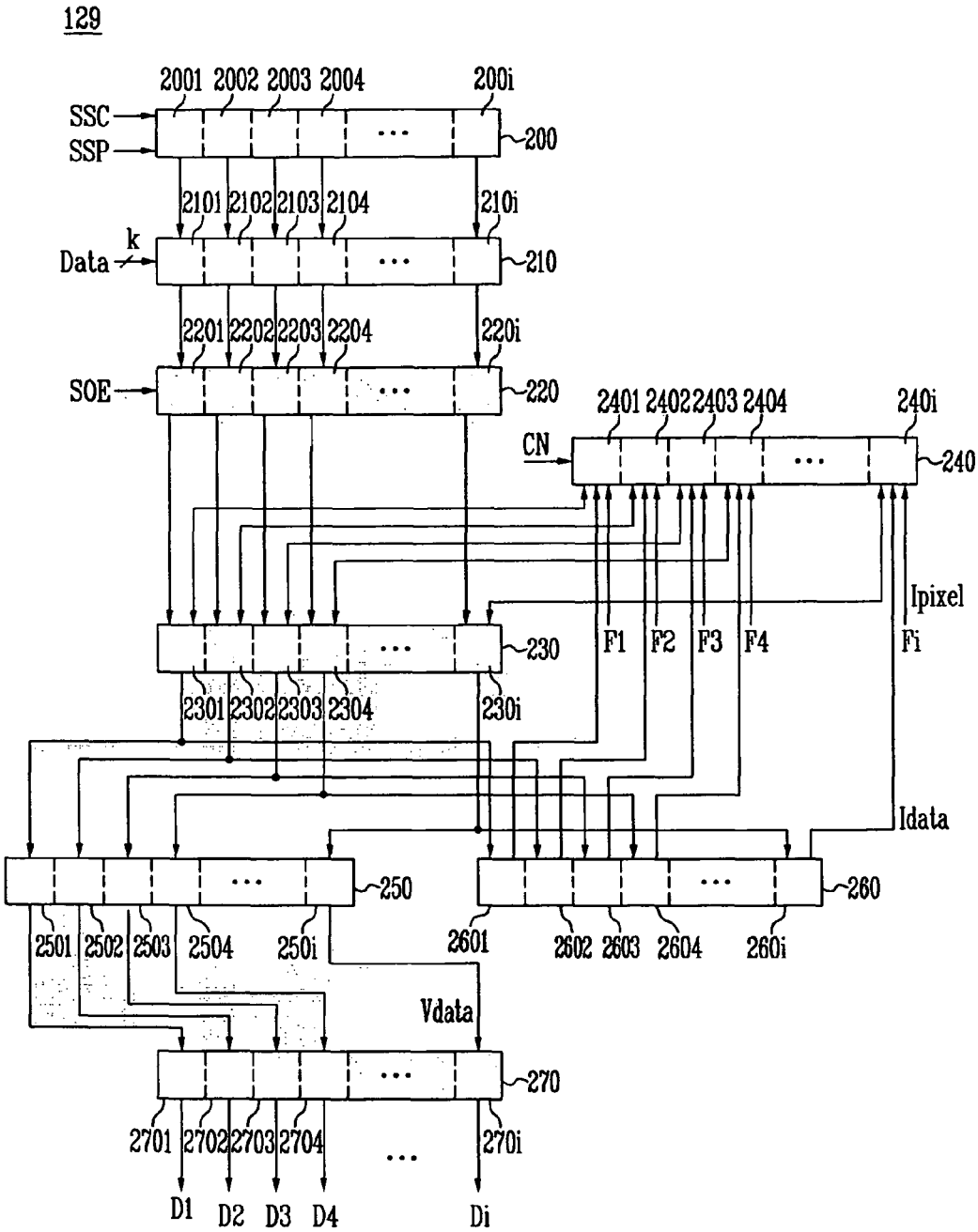
FIG. 3 is a block diagram of an embodiment of the data driving integrated circuit of FIG. 2.

FIG. 3 is a block diagram of the data driving integrated circuit of FIG. 2.

Referring to FIG. 3, a data driving integrated circuit 129 comprises a shift register 200 to generate sampling signals sequentially; a sampling latch 210 to sequentially store data in response to the sampling signal; a holding latch 220 to temporally store the data of the sampling latch 210 and to transmit the data stored therein; a register 230 to temporally store the data transmitted from the holding latch 220; a data control block 240 to increase or decrease the bit value of the data stored in the register 230; a Voltage Digital-Analog Converter (VDAC) 250 to generate a gradation voltage Vdata corresponding to the bit value of the data Vdata stored in the register 230; a Current Digital-Analog Converter (IDAC) 260 to generate a gradation current Idata corresponding to the bit value of the data stored in the register 230; a buffer 270 to supply the gradation voltage Vdata supplied from the VDAC 250 to data lines D1 through Dj.

The shift register 200 receives a Source Shift Clock (SSC) and a Source Start Pulse (SSP) from the timing controller 150, and j sampling signals sequentially while shifting the source start pulse SSP per one cycle of the source shift clock SSC. The shift register 200 comprises j shift registers (2001 through 200*j*).

The sampling latch 210 stores the data Data in response to the sampling signals sequentially transmitted from the shift register 200. The sampling latch 210 comprises j sampling latches 2101 through 210*j* in order to store j data. Furthermore, each sampling latch 2101 through 210*j* has a size corresponding to the bit value of the data. For example, in the case of the data of k bits, each sampling latch 2101 through 210*j* is set to have a size corresponding to k bits.

The register 230 temporally stores the data supplied from the holding latch 220. The data stored in the register 230 is supplied to the data controller 240, the VDAC 250 and the IDAC 260. The register 230 comprises j registers 2301 through 230*j* each set to have a size corresponding to k bits.

The data control block 240 receives the gradation current Idata, the pixel current Ipixel and data Data, and compares the gradation current Idata with the pixel current Ipixel. Then, the data controller 240 adjusts the bit value of the data Data on the basis of the compared current difference. Preferably, the data controller 240 adjusts the bit value of the data in order to make the gradation current Idata equal to the pixel current Ipixel. The data adjusted in the data controller 240 (hereinafter referred to as "reset data") is returned to the register 230. The data controller 240 comprises j data controllers 2401 through 240*j*.

The VDAC 250 generates the gradation voltage Vdata corresponding to the bit value of the data Data or reset data, and supplies the gradation voltage Vdata to the buffer 270. The VDAC 250 generates j gradation voltage Vdata corresponding to j data (or reset data) transmitted from the register 230. The VDAC 250 comprises j gradation voltage generators 2501 through 250*j*.

IDAC 260 generates the gradation current Idata corresponding to the bit value of the data Data, and supplies it to the data controller 240. IDAC 260 generates j gradation current Idata in correspondence to j data transmitted from the register 230. The IDAC 260 comprises j gradation current generators 2601 through 260*j*.

The buffer 270 supplies the gradation voltage supplied from the VDAC 250 to j data lines D1 through Dj. The buffer 270 comprises j buffers 2701 through 270*j*.

Figure 4:
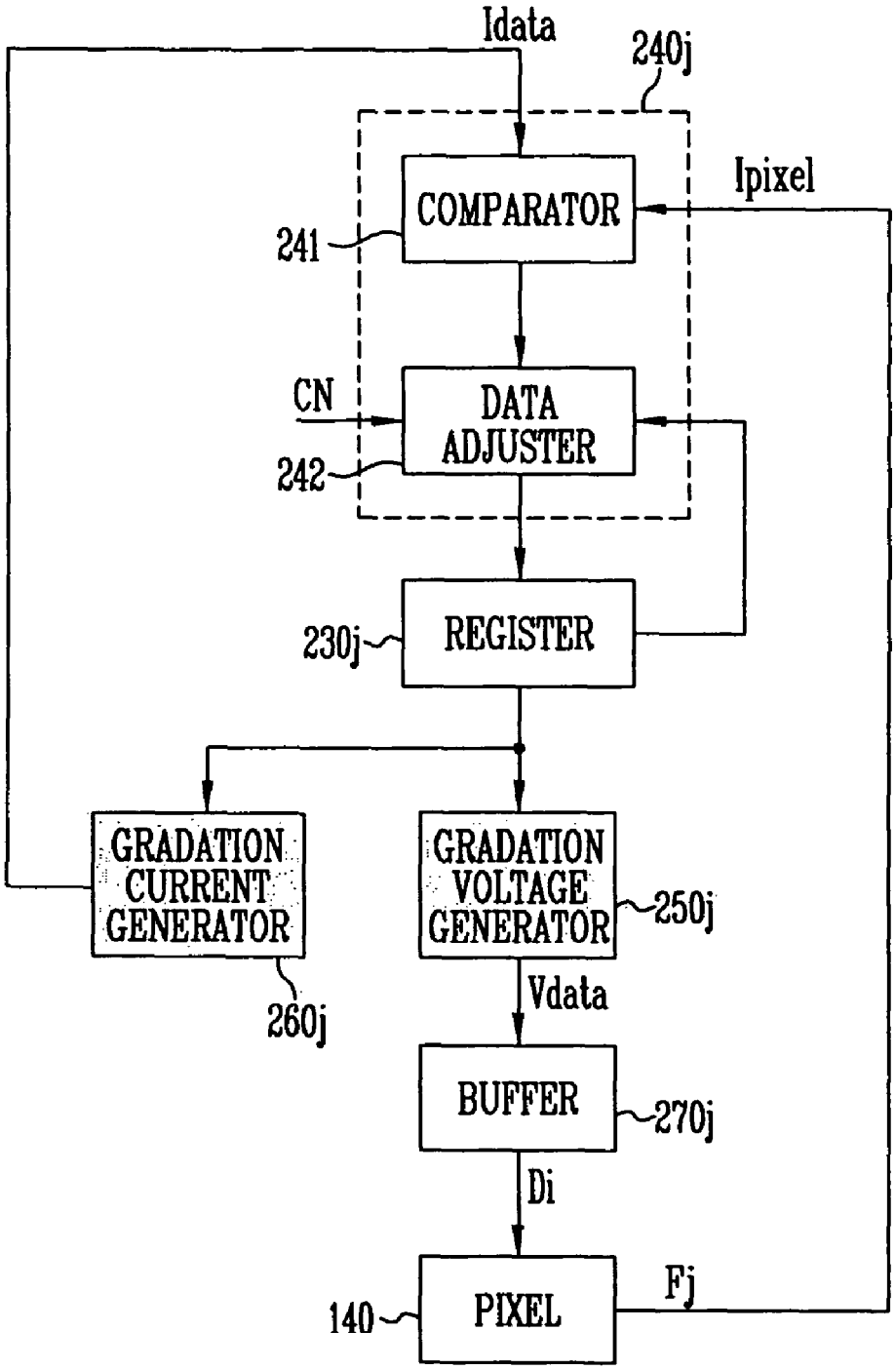
FIG. 4 is a detailed block diagram of the data control block of FIG. 3.

FIG. 4 is a detailed block diagram of the data controller of FIG. 3. For the sake of convenience, the jth data controller is illustrated.

Referring to FIG. 4, a data controller 240*j* of the present invention comprises a comparator 241 and a data adjuster 242.

The comparator 241 receives the gradation current Idata and the pixel current Ipixel from the gradation current generator 260*j* and the pixel 140, respectively. The pixel current Ipixel is supplied from the pixel 140 that is receiving the current gradation voltage Vdata (i.e., data signal). Then, the comparator 241 compares the pixel current Ipixel with the gradation current Idata, and supplies a first control signal or a second control signal to the data adjuster 242 on a basis of the compared result. For example, when the gradation current Idata is higher than the pixel current Ipixel, the comparator 241 generates the first control signal. On the other hand, when the gradation current Idata is lower than the pixel current Ipixel, the comparator 241 generates the second control signal.

The data adjuster 242 receives the data Data from the register 230*j* and stores it therein. Furthermore, the data adjuster 242 receives the first control signal or the second control signal from the comparator 241, and receives a constant value CN from the outside. Then, the data adjuster 242 increases or decreases the bit value of the data Data by the constant value CN, thereby adjusting the data Data. The data Data adjusted by the data adjuster 242 is supplied to the register 230*j*.

The data controller operates as follows. The register 230*j* supplies the data Data from the holding latch 220*j* to the data adjuster 242, the gradation voltage generator 250*j*, and the gradation current generator 260*j*. The gradation voltage generator 250*j* receives the data Data, generates the gradation voltage Vdata corresponding to the bit value of the data Data, and supplies the gradation voltage Vdata to the buffer 270*j*. The gradation voltage Vdata is supplied from the buffer 270*j* to the pixel 140 via the data line Dj. The pixel 140 supplies the pixel current Ipixel corresponding to the data signal to the feedback lines Fj.

The gradation current generator 260*j* receives the data Data and generates the gradation current Idata corresponding to the bit value of the data Data. The gradation current Idata is supplied to the comparator 241. Then, the comparator 241 receives the pixel current Ipixel and the gradation current Idata from the feedback lines Fj and the gradation current generator 260*j*, respectively. The gradation current Idata is an ideal current to flow in the pixel 140 in correspondence to the data, and the pixel current Ipixel is an actual current flowing in the pixel 140. Then, the comparator 241 compares the pixel current Ipixel with the gradation current Idata, and generates the first control signal or the second control signal on the basis of the compared result, thereby supplying the first control signal or the second control signal to the data adjuster 242.

The data adjuster 242 receives the first control signal or the second control signal, and increases or decreases the stored data Data by the constant value CN, thereby generating the reset data Data. The reset data Data is supplied to the register 230*j*. The data adjuster 242 adjusts the bit value of the data Data to approximately equalize the pixel current Ipixel with the gradation current Idata. For example, in the case where the data adjuster 242 receives the first control signal, the data adjuster 242 decreases the bit value of the data Data by the constant value CN, thereby increasing the pixel current Ipixel. On the other hand, in the case where the data adjuster 242 receives the second control signal, the data adjuster 242 increases the bit value of the data Data by the constant value CN, thereby decreasing the pixel current Ipixel. The constant value CN has been previously set to a predetermined value.

The reset data Data is supplied from the data adjuster 242 to the register 230*j*. Then, the register 230*j* supplies the reset data Data to the gradation voltage generator 250*j*. Then, the gradation voltage generator 250*j* generates the gradation voltage Vdata using the reset data Data, and supplies the gradation voltage Vdata to the pixel 140 via the buffer 270*j*. The pixel 140 receives the gradation voltage Vdata and generates the pixel current Ipixel corresponding to the gradation voltage Vdata, thereby supplying the pixel current Ipixel to the comparator 241. Substantially, the aforesaid processes are repeated a predetermined number of times per horizontal period 1H, thereby controlling a desired pixel current Ipixel to flow in the pixel 140.

Figure 5:
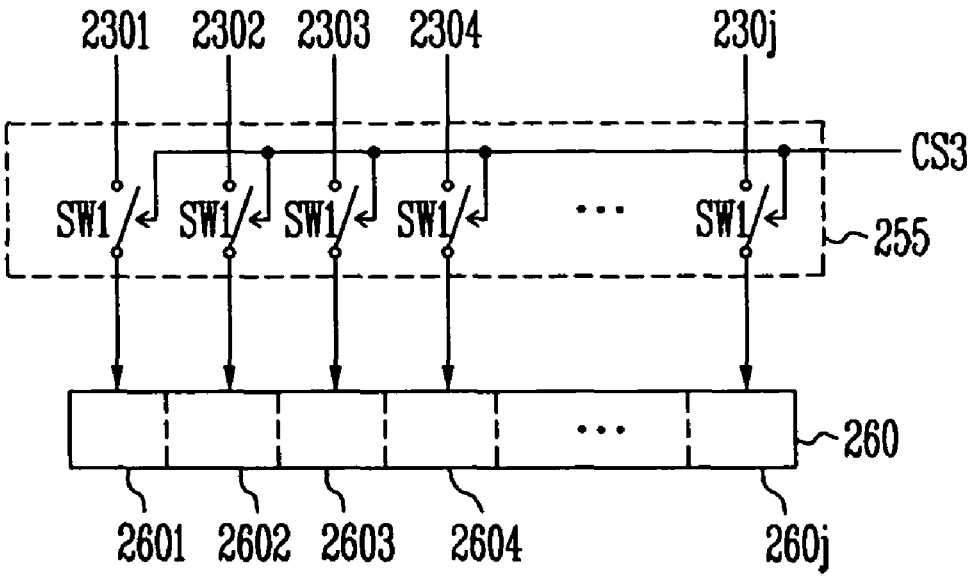
FIG. 5 is a block diagram of a selector provided anterior to the current digital-analog converter of FIG. 2.

Referring to FIG. 4, the gradation current generator 260*j* can generate the gradation current Idata correspondence to the reset data Data. Actually, the gradation current Idata generated corresponding to the reset data is not an ideal current which should flow in the pixel 140. Therefore, when the gradation current Idata corresponding to the reset data Data is supplied to the comparator 141, an undesired pixel current Ipixel flows in the pixel 140. To solve this problem, a selector 255 can be additionally provided between the register 230 and IDAC 260 as shown in FIG. 5.

Figure 6:
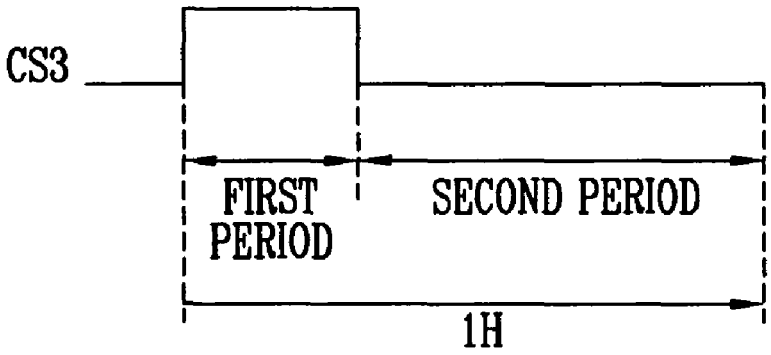
FIG. 6 is a view of a waveform of a selection signal supplied to the selector of FIG. 5.

The selector 255 comprises switching devices SW1 provided corresponding to respective channels. For example, the selector 255 comprises j switch devices SW1. Referring to the FIG. 6, the switching device SW1 is turned on in response to a third control signal CS3 for a first period of one horizontal period, and turned off for the rest of one horizontal period, i.e., a second period. During the first period for turning on the switching device SW1, the IDAC 260 receives the data Data from the register 230. Furthermore, during the second period for storing the reset data in the register 230, the switching device SW1 is turned off. Thus, the IDAC 260 generates only the gradation current Idata corresponding to the data Data, and controls the pixel current Ipixel to flow in the pixel 140.

Figure 7:
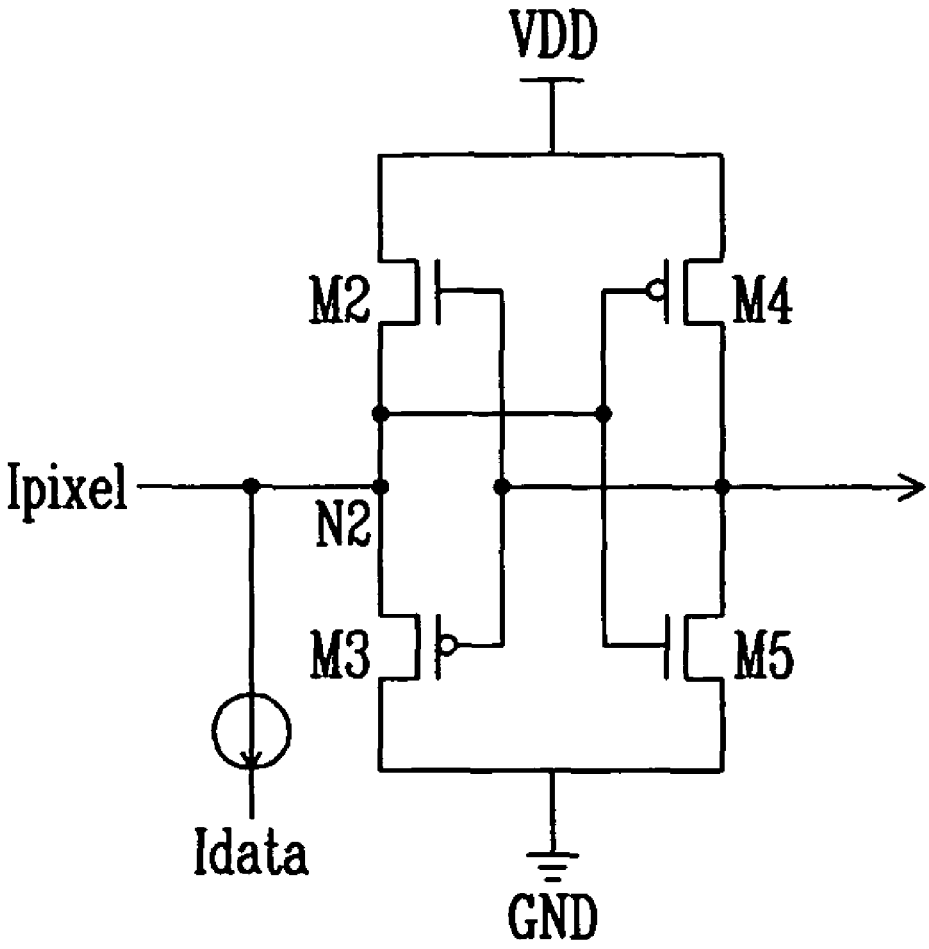
FIG. 7 is a circuit diagram of the comparator of FIG. 4.

FIG. 7 is a circuit diagram of the comparator of FIG. 4. The comparator illustrated in FIG. 7 was disclosed by the Institute of Electrical and Electronics Engineers (IEEE) in 1992. However, the comparator according to an embodiment of the present invention is not limited to that proposed by the IEEE. Alternatively, various well-known comparators may be used in the present invention.

Referring to FIG. 7, the current corresponding to the difference between the pixel current Ipixel and the gradation current Idata is supplied to a second node N2. Then, the current is supplied from the second node N2 to gate terminals of a fourth transistor M4 and a fifth transistor M5 formed as an inverter. Then, either of the fourth transistor M4 or the fifth transistor M5 is turned on, thereby supplying a high voltage VDD or a low voltage GND to an output terminal. The voltage supplied to the output terminal is supplied to the gate terminals of the second and third transistors M2 and M3, thereby stably maintaining the voltage supplied to the output terminal.

As described above, the present invention provides a data driving integrated circuit, a light emitting display using the data driving integrated circuit, and a driving method thereof, which compares a gradation current corresponding to data with a pixel current flowing in a pixel, and adjusts a bit value of the data on the basis of the compared results so as to approximately equalize the pixel current with the gradation current, thereby displaying an image with a desired brightness. Particularly, according to an embodiment of the present invention, the bit value of the data is adjusted on the basis of the pixel current fed back from each pixel, so that an image is displayed with a desired brightness regardless of non-uniform threshold voltages between transistors.

Although a few embodiments of the present invention have been shown and described, it would be appreciated by those skilled in the art that modifications can be made to this embodiment without departing from the principles and spirit of the present invention, the scope of which is defined by the following claims.

What is claimed is:

1. A data driving integrated circuit, comprising:

a shift register adapted to generate sampling signals in sequence;

a latch adapted to store external data in response to the sampling signal;

a register adapted to temporarily store the data stored in the latch;

a voltage digital-analog converter adapted to generate a gradation voltage corresponding to the data stored in the register;

a current digital-analog converter adapted to generate a gradation current corresponding to the data stored in the register;

a buffer adapted to supply the gradation voltage as a data signal to a pixel; and a data controller adapted to receive a pixel current flowing in the pixel in correspondence to the gradation voltage and fed back from the pixel and to adjust a bit value of the data stored in the register.

2. The data driving integrated circuit according to claim 1, wherein the data controller is adapted to compare the pixel current with the gradation current, and to increase or decrease the bit value of the data stored in the register on the basis of compared results.

3. The data driving integrated circuit according to claim 2, wherein the data controller is adapted to increase or decrease the bit value of the data by a previously set constant value.

4. The data driving integrated circuit according to claim 2, wherein the data controller comprises j data controllers adapted to adjust the bit values of j data (where, j is a natural number).

5. The data driving integrated circuit according to claim 4, wherein each data controller comprises:

a comparator adapted to compare the pixel current with the gradation current; and a data adjuster adapted to adjust the bit value of the data stored in the register on the basis of control by the comparator.

6. The data driving integrated circuit according to claim 5, wherein the data adjuster is adapted to adjust the bit value of the data to make the pixel current equal to the gradation current.

7. The data driving integrated circuit according to claim 5, further comprising a selector arranged between the register and the current digital-analog converter.

8. The data driving integrated circuit according to claim 7, wherein the selector comprises j switching devices, each switching device being adapted to be turned on for a first period of one horizontal period to supply the data from the register to the current digital-analog converter, and to be turned off for a second period of one horizontal period except for the first period to prevent the data having the adjusted bit value from the register being supplied to the current digital-analog converter.

9. The data driving integrated circuit according to claim 1, wherein the latch comprises:

a sampling latch adapted to store the data in sequence in response to the sampling signal; and a holding latch adapted to store the data stored in the sampling latch and at the same time to supply the stored data to the register.

10. A light emitting display device, comprising:

a plurality of scan lines;

a plurality of data lines and feedback lines arranged to intersect the scan lines;

a pixel portion including a plurality of pixels connected to the scan lines, the data lines and the feedback lines;

a scan driver adapted to supply scan signals to the scan lines in sequence; and a data driver connected to the data line and the feedback lines and adapted to convert external data into a gradation voltage, and to supply the gradation voltage to the data line;

wherein the data driver is adapted to receive a pixel current flowing in each pixel corresponding to the gradation voltage, and to adjust a bit value of the data in accordance with the received pixel current.

11. The light emitting display device according to claim 10, wherein the data driver comprises at least one data driving integrated circuit, each data driving integrated circuit comprising:

a shift register adapted to generate sampling signals in sequence;

a latch adapted to store external data in response to the sampling signal;

a register adapted to temporarily store the data stored in the latch;

a voltage digital-analog converter adapted to generate a gradation voltage corresponding to the data stored in the register;

a current digital-analog converter adapted to generate a gradation current corresponding to the data stored in the register;

a buffer adapted to supply the gradation voltage as a data signal to a pixel; and a data controller adapted to receive a pixel current flowing in the pixel in correspondence to the gradation voltage and fed back from the pixel and to adjust a bit value of the data stored in the register.

12. The light emitting display device according to claim 11, wherein the data controller is adapted to compare the pixel current with the gradation current, and to increase or decrease the bit value of the data stored in the register by a previously set constant value on the basis of compared results.

13. The light emitting display device according to claim 12, wherein the data controller comprises j data controllers adapted to adjust the bit values of j data (where, j is a natural number).

14. The light emitting display device according to claim 13, wherein each data controller comprises:

a comparator adapted to compare the pixel current with the gradation current; and a data adjuster adapted to adjust the bit value of the data stored in the register on the basis of control by the comparator.

15. The light emitting display device according to claim 14, wherein the data adjuster is adapted to adjust the bit value of the data to make the pixel current equal to the gradation current.

16. A method of driving a light emitting display device, the method comprising:

generating a gradation voltage and a gradation current corresponding to data;

supplying the gradation voltage to pixels;

comparing a pixel current flowing in one pixel in correspondence to the gradation voltage and fed back from the one pixel with the gradation current generated corresponding to the data; and adjusting a bit value of the data on the basis of compared result.

17. The method according to claim 16, wherein adjusting a bit value of the data on the basis of compared result comprises increasing or decreasing the bit value of the data to equalize the pixel current with the gradation current.

18. The method according to claim 17, wherein adjusting a bit value of the data on the basis of compared result comprises increasing or decreasing the bit value of the data by a previously set constant value.

* * * * *